US009440710B2

(12) United States Patent
Larsen et al.

(10) Patent No.: US 9,440,710 B2
(45) Date of Patent: Sep. 13, 2016

(54) ROPE STOPPER SYSTEM EQUIPPED WITH A BACK SUPPORT

(71) Applicant: ROLLS-ROYCE MARINE AS, Ålesund (NO)

(72) Inventors: André Liavåg Larsen, Ålesund (NO); Guillaume Peigne, Trondheim (NO)

( * ) Notice: Subject to any disclaimer, the term of this patent is extended or adjusted under 35 U.S.C. 154(b) by 0 days.

(21) Appl. No.: 14/407,947

(22) PCT Filed: Jun. 11, 2013

(86) PCT No.: PCT/NO2013/000025
§ 371 (c)(1),
(2) Date: Dec. 13, 2014

(87) PCT Pub. No.: WO2013/187769
PCT Pub. Date: Dec. 19, 2013

(65) Prior Publication Data

US 2015/0166145 A1 Jun. 18, 2015

(30) Foreign Application Priority Data

Jun. 13, 2012 (NO) ..... 20120685

(51) Int. Cl.
*B63B 21/08* (2006.01)

(52) U.S. Cl.
CPC ..... *B63B 21/08* (2013.01)

(58) Field of Classification Search
CPC ..... B63B 21/08
See application file for complete search history.

(56) References Cited

U.S. PATENT DOCUMENTS

| | | | | |
|---|---|---|---|---|
| 1,265,141 | A * | 5/1918 | Trippe | E21B 31/18 211/60.1 |
| 4,068,608 | A | 1/1978 | Hartz | |
| 4,458,631 | A * | 7/1984 | Hystad | B63B 21/22 114/199 |
| 7,337,504 | B1 | 3/2008 | Casey | |
| 2004/0187757 | A1 | 9/2004 | Siewert et al. | |

FOREIGN PATENT DOCUMENTS

| | | |
|---|---|---|
| WO | 2007021195 A1 | 2/2007 |
| WO | 2010002265 A1 | 1/2010 |

OTHER PUBLICATIONS

International Preliminary Report on Patentability for PCT/NO2013/000025 with a date of completion of Sep. 8, 2014.
International Search Report for PCT/NO2013/000025 dated Sep. 25, 2013.
Written Opinion for PCT/NO2013/000025 mailed Jun. 11, 2014.

* cited by examiner

*Primary Examiner* — Edwin Swinehart
(74) *Attorney, Agent, or Firm* — Ben Schroeder Law PLLC

(57) ABSTRACT

A rope stopper system for a fiber rope (30) is described, where a rope stopper (10) is placed on a deck of an anchor handling vessel (50) or the like, and is arranged to grip and secure the fiber rope (30), that runs through the rope stopper (10). The rope stopper (10) comprises a frame (12) equipped with at several rotary stopper elements (14), where the stopper elements (14) are arranged in an opening (16) in the frame (12), said opening (16) being a through-running opening to receive the fiber rope (30), and where the stopper elements (14) are placed radially in the opening, and about the through-running fiber rope (30), arranged to lock the fiber rope (30), and the rope stopper (10) is equipped with a back support (22), in where the back support (22) is designed with an arched back side.

12 Claims, 4 Drawing Sheets

ROPE STOPPER SYSTEM EQUIPPED WITH A BACK SUPPORT

This application claims priority under 35 USC 371 to PCT/NO2013/000025 filed Jun. 11, 2013, which in turn claims priority under 35 USC 119 to NO20120685 filed Jun. 13, 2012, both of which are hereby incorporated by reference in their entireties.

The present invention relates to a rope stopper system for a fibre rope, where a rope stopper is placed on a deck of an anchor handling vessel or the like, and is arranged to grip and secure the fibre rope that runs through the rope stopper.

On, for example, an anchor handling vessel, a towing pin is often used to steer and guide a chain, wire, cable, or the like to the mouth area of a shark jaw. A shark jaw is normally used to grip and secure said chain or cable. Such shark jaws are normally formed to hold and grip around the chain or cable, for example, in connection with reshackling or other operations.

Fibre ropes have gradually been used for the handling of heavy loads in the form of, for example, anchors and subsea equipment for the oil and gas industry. Fibre ropes are now used more and more at great ocean depths, as such ropes have a lower specific weight and thereby make the heavy lifting easier. A shark jaw as described above is not suited to be used on fibre ropes. Therefore, it is possible to use the present invention instead of a shark jaw, or alternatively in addition to such equipment.

From prior art, reference is made to WO 2007/021195A1, which describes a centring device that is arranged to guide and grip a wire, chain, cable, etc. The device comprises a box which is fitted with at least two raisable and rotary guiding plates, where the guiding plates with contact surfaces can have an eccentric or oval shape and can rotate about a bearing point. The guiding plates are arranged so that they shall guide or grip the rope between the respective guiding plates. Contrary to the present invention, the guiding plates are, in the main, arranged transversely to said wire, chain or cable, so that when the guiding plates are raised, the end edges of the guiding plates are arranged to lie against said wire, chain or cable to counteract the associated rotation.

Furthermore, reference is made to US 2004/187757 A1 which shows an example of a rope stopper that is commonly used on yachts. The rope stopper comprises a base with two stopper elements that can rotate about a bearing point. The stopper elements have a cylindrical or oval shape with a contact surface for the gripping of the rope.

Consequently, it is an object of the present invention to provide a solution that can be used to grip and secure fibre ropes on a vessel, such as an anchor handling vessel that is used in connection with offshore operations, and which is simple and easy to use.

A further object is also to provide a solution that can easily be moved around the deck of the vessel and can simply be placed next to existing equipment on the deck.

A further object is to provide a rope stopper which can adjust itself after the angle or direction of the rope.

The above mentioned objects are reached with a rope stopper system for a fibre rope, where a rope stopper is placed on the deck of an anchor handling vessel or the like and is arranged to grip and secure the fibre rope that runs through the rope stopper, in connection with reshackling and the like. The rope stopper comprises a frame equipped with several rotary stopper elements, where the stopper elements are arranged in an opening in the frame, said opening being a through-running opening to receive the fibre rope, and where the stopper elements are placed radially in the opening and about the through-running fibre rope, arranged to lock the fibre rope, and the rope stopper is equipped with a back support, in where the back support is designed with an arched back side.

Alternative embodiments are given in the respective dependent claims.

The back side of the back support can be designed with a parabolic or spherical shape. The back support may also be releasable mounted to the rope stopper.

An outer surface of the stopper elements can be equipped with a contact surface, which during rotation of the stopper element is arranged to lock the fibre rope, and that the contact surface is arranged at a point on the outer surface that lies further away from the bearing point of the stopper element than at least the most of the other points in the outer surface of the stopper element.

Said stopper element can be supported eccentrically with respect to the contact surface of the stopper element with the fibre rope. Further, the stopper element can have an eccentric shape or an oval shape.

The contact surface can have an external curved radius. Further, the contact surface can be equipped with a rubber covering. The curved shape of the contact surface, or the rubber covering, can change with the circumference about the stopper element.

Said back supports can be arranged to be placed between the cylinders of a towing pin.

Furthermore, the stopper elements can be arranged to be rotated in synchrony.

The rope stopper can comprise a motor connected to at least one of the stopper elements, and said stopper element is preferably connected via a drive unit to the other stopper elements, which are not connected to the motor.

The invention shall now be described in more detail with the help of the enclosed figures, in which.

Figure 6A:
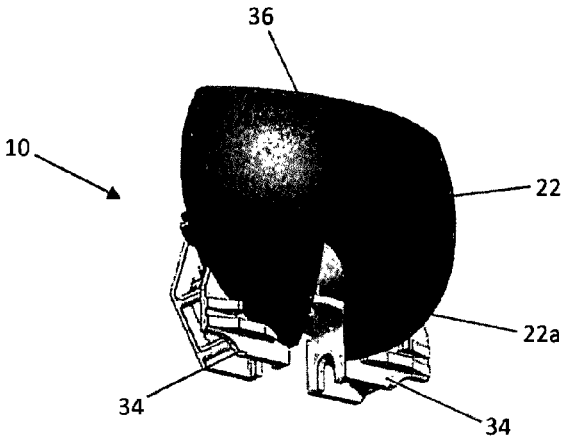
Figure 6B:
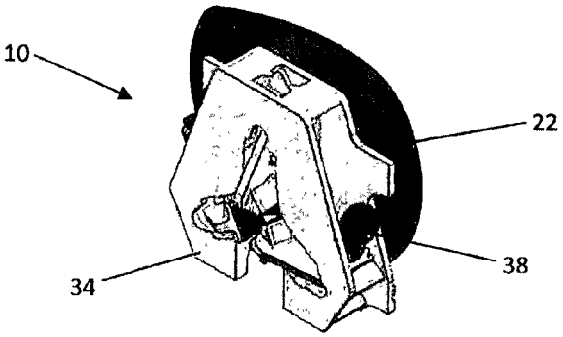

FIGS. 6*a* and 6*b* show schematics of the rope stopper according to the invention, seen from front and rear, respectively.

Figure 7:
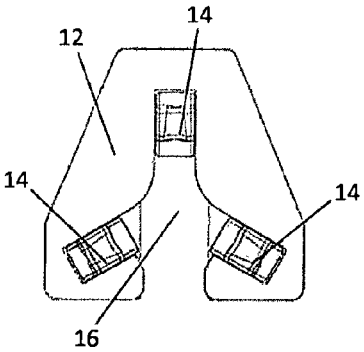
Figure 8:
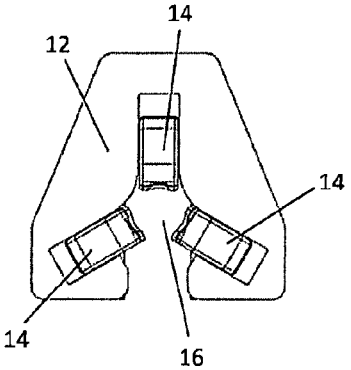
Figure 9:
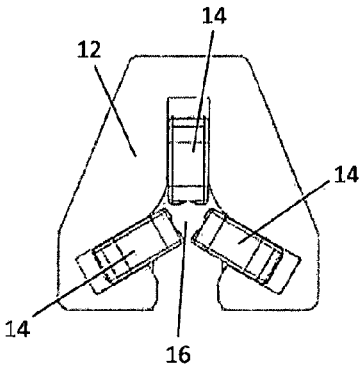

FIGS. 7, 8 and 9 show a front schematic of the rope stopper according to the invention and with stopper elements in different positions.

Figure 10:
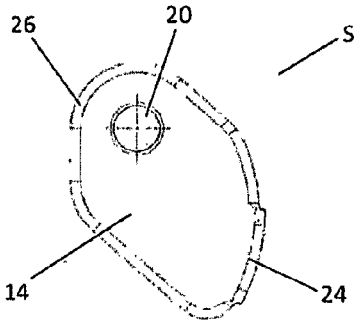
Figure 11:
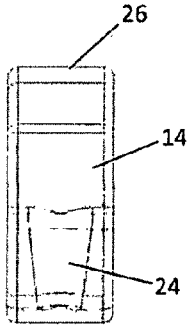
Figure 12:
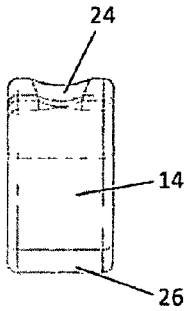

FIGS. 10, 11 and 12 show different schematics of a stopper element according to the invention.

Figure 13:
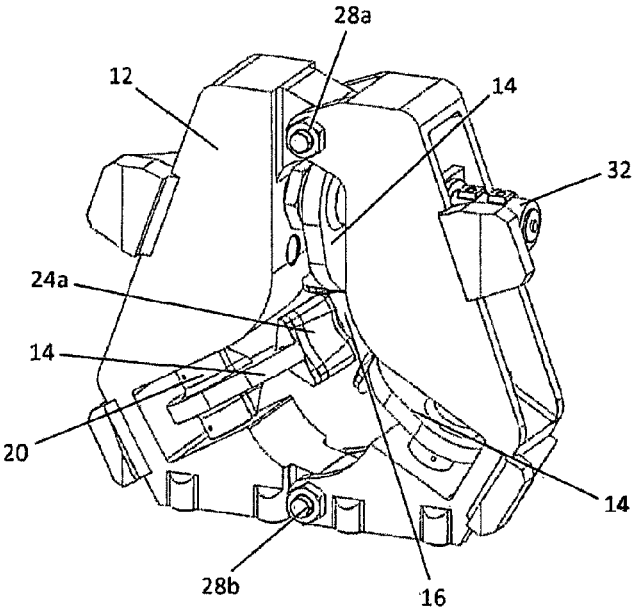

FIG. 13 show an alternative embodiment of a rope stopper according to the invention.

Figure 1:
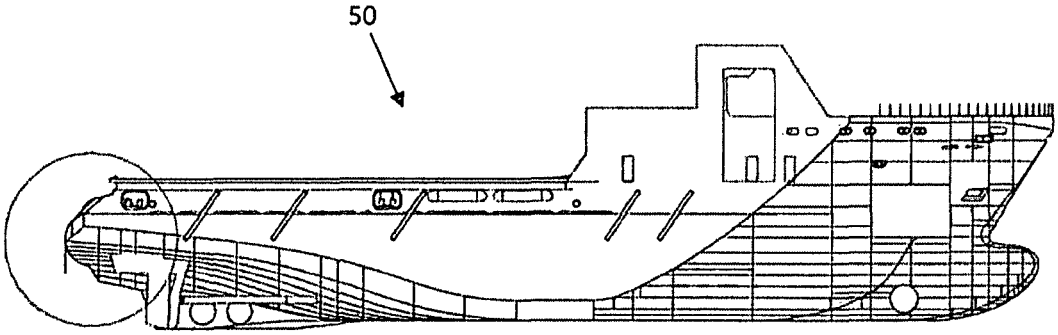
FIG. 1 shows a principle drawing of an example of an anchor handling vessel that can use the present invention.
Figure 2:
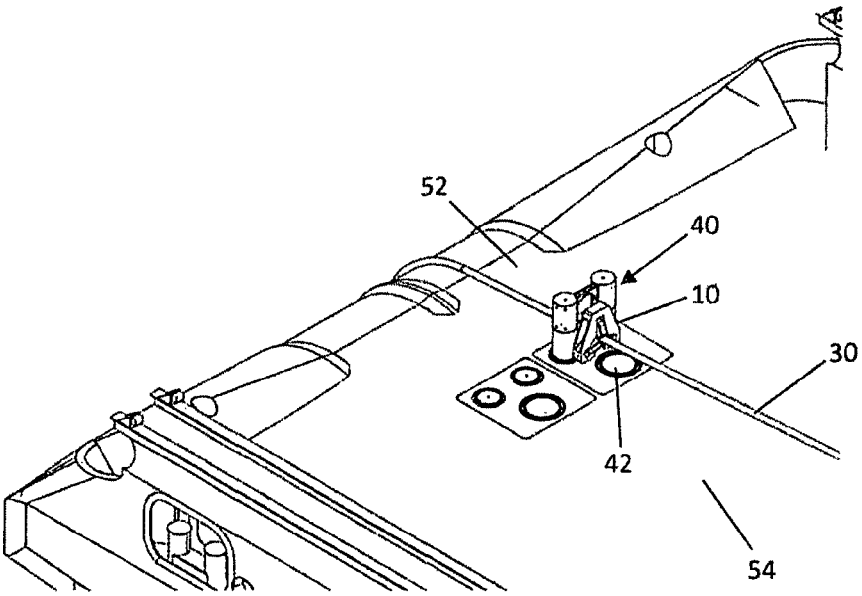
FIG. 2 shows in more detail the aft end of the vessel shown in FIG. 1.

FIG. 1 shows a principle drawing of an anchor handling vessel 50 that can be equipped with the solution according to the invention. FIG. 2 shows in more detail an aft end 52 of the vessel 50, and shows a rope in the form of a fibre rope 30 that runs on a deck 54, from a winch (not shown) placed further forward on the deck, and over, for example, a roller at the aft end and down into the sea. The fibre rope 30 can, in this connection, be used for handling of heavy loads in the form of, for example, anchors and subsea equipment for the oil and gas industry. At great ocean depths fibre ropes are being used more and more, as such ropes have a lower specific weight and thus make heavy lifts easier.

A rope stopper 10 according to the invention can be placed at the aft end 52, or anywhere on the deck 54 for that matter. However, in the embodiment example shown the rope stopper 10 is shown placed adjoining a towing pin 40 which is normally used to steer and guide a chain, wire, cable or the like to the mouth area of a shark jaw (nor shown). A shark jaw 42 is indicated driven down into the deck, and is normally used for gripping and securing of said chain or cable. Such shark jaws are normally shaped to grip the chain or the cable, and are therefore not suited to be used with fibre ropes. Therefore, it will be possible to use the present invention instead of such a shark jaw, or alternatively in addition to such equipment.

Figure 3:
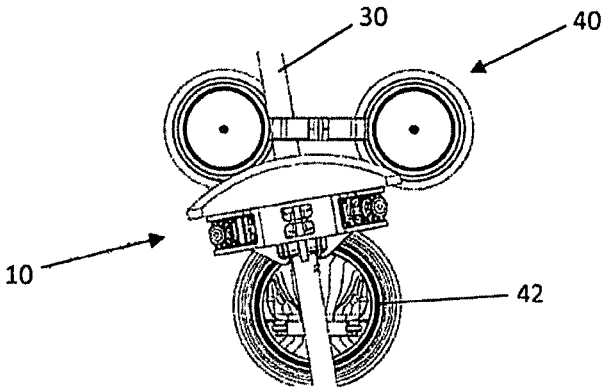
FIGS. 3, 4 and 5 show a rope stopper according to the invention placed next to a towing pin.
Figure 4:
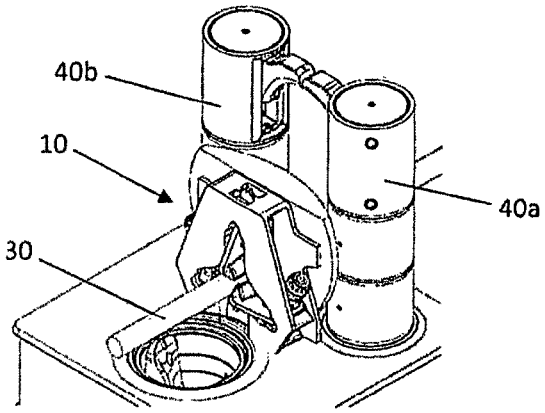
Figure 5:
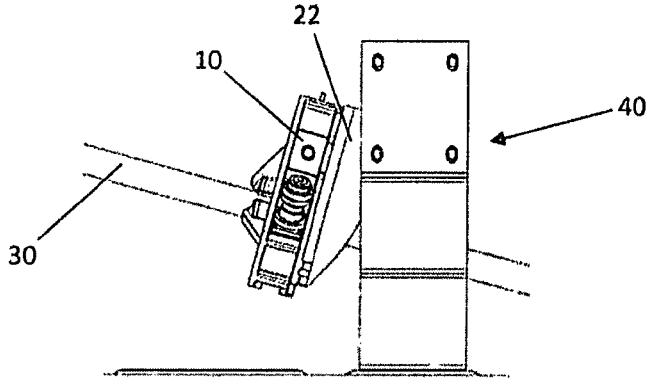

As FIG. 3-5 shows in more detail, the rope stopper 10 according to the invention is, for example, placed next to the towing pin 40, i.e. in more detail the rope stopper 10 rests against the two driven up cylinders 40*a*, 40*b* of the towing pin. To secure the rope stopper 10 when it is placed in this way, the rope stopper is preferable equipped with a back support 22 that can lie against the cylinders 40*a*, 40*b* of the towing pin 40. Thus, the towing pin 10 can be loose or fastened between the cylinders so that it can become loose and the towing pin arrangement will thereby take up the forces when the rope stopper 10 engages with the fibre rope 30.

In the embodiment shown, the rope stopper 10 comprises a frame 12 which, among other things, the back support 22 is fastened to. Furthermore, the frame 12 is equipped with a downwardly directed opening 16 where several stopper elements 14, also called friction wheels, are mounted so that they can rotate. Thereby, the rope stopper 10 can be threaded over the fibre rope 30 and rest against the cylinders 40*a*, 40*b* of the towing pin 40. In the case of the rope stopper being driven up or down as described, the opening will naturally be directed upwards.

The back support 22 is on its back side, i.e. the side facing the towing pin 40, preferable designed with an at least spherical or parabolic shape. The external arched surface of the back support thereby allows the rope stopper 10 to rest against the two cylinders 40*a*, 40*b* in different angles, and in that manner to follow the direction of the rope 30. This results in that the rope will remain as balanced as possible between the stopper elements 14. The back support 22 may further be equipped with a truncated upper edge 36, which can be level with the upper part of the rope stopper 10. The other side of the back support 22, i.e. the front side, is preferable plane or adapted to the frame 12 and is connected to the frame 12.

The external arched surface of the back support 22 is in total arched, and the surface may therefore consist of a smooth arched surface or several surfaces, which themselves can be plane, and which compounded display an arched surface.

As seen from FIG. 6*a*, the back support 22 can be equipped with an opening 22*a*, in where the opening is directed downwards, and in where the opening 22*a* is arranged to receive and accommodate the fibre rope 30. The rope stopper 10 can further be equipped with one or more footrests 34, which may rest on the base adjacent the towing pin 40.

The stopper elements 14 can be rotated so that they do not engage with the fibre rope 30, and are then in an open position, or the stopper elements 14 can be rotated so that they engage with the fibre rope 30, as shown in FIGS. 7-9, where FIG. 7 shows the stopper elements 14 in an open position, FIG. 8 shows the stopper elements in partially closed position or closed position in the case of fibre ropes of a large diameter, and FIG. 9 shows the stopper elements in a closed position in the case of fibre ropes with smaller diameters. As the figures show, the stopper elements 14 (which are, as mentioned, also called friction wheels) are mounted mutually spaced apart in the frame 12 about a central, imaginary longitudinally running axis through the opening 16. This axis will be able to correspond to the longitudinal axis of the fibre rope when the fibre rope runs through the opening. Thus, the rope stopper 10 can hold different fibre ropes of different diameters. Furthermore, preferably three stopper elements are used so that the fibre rope can be optimally held tight. The use of three stopper elements will, of course, centre the fibre rope.

The frame shown in the FIGS. 3-9 can also be closed at the bottom of the opening 16 with the help of stays, bolts or the like so that the frame is given an increased strength against torsion and the like. The same may apply for the back support 22.

So that the stopper elements 14 shall grip about the fibre rope 30 when they are rotated, they are preferably formed so that a contact surface 24 meets the fibre rope 30, and where the contact surface 24 moves eccentrically with regard to a bearing point 20 for the stopper element 14. This is shown in FIG. 10 in that the stopper element has an eccentric form, as opposed to the circular form shown by the circle arch S, i.e. for example an approximate oval form and with the bearing point 20 placed eccentrically with regard to the centre of the form. This will be the best solution that provides the most power, but the stopper element 14 can alternatively also have an approximately circular shape and with the bearing point eccentrically in relation to the centre, or in an oval or the like with the bearing point centrally. Most importantly is that the contact surface 24 of the stopper element 14 is arranged at a point that lies further away from the bearing point 20 of the stopper element than at least most of the outer surface 26 of the stopper element.

During reshackling or the like, or when tension arises in the fibre rope 30, the stopper elements 14 will thereby be able to be rotated in a controlled way counter-clockwise, so that the contact surfaces 24 of every element will be forced against the fibre rope for the rope to be gripped, and during pulling in or after reshackling of the fibre rope 30, the stopper elements 14 will be able to be rotated in a controlled way clockwise so that the contact surfaces 24 disengage with the fibre rope, and also so that the rest of the outer surface, indicated by 26, does not come into contact with the fibre rope 30 either. The rope stopper 10 can be equipped with means for controlled rotation of the stopper elements 14. Furthermore, the rope stopper 10 can be equipped with means to lock the stopper elements 14 in any desired position.

For rotation of the friction wheels, or the arm/axle which they are mounted to, against the rope 30, the frame can comprise a number of hydraulic cylinders 38 or motors, preferable one for each arm/axle or friction wheel.

FIG. 13 shows a further variant of the rope stopper 10 and comprises, in a corresponding way, a frame 12 with several stopper elements 14 placed about an opening 16*a* where the fibre rope 30 runs. Here, the rope stopper 10 is in closed form so that the opening 16*a* is only a through-running opening, contrary to the earlier variants that show an upwardly or downwardly open and through-running opening 16. In this version, the frame can be connected by an upper hinge 28*a*, and can be opened in two frame part halves that can be opened and be threaded over the fibre rope 30. The two frame half parts can be locked in a lower connection 28*b*, for example, with the help of a through-running bolt or the like. FIG. 13 shows further that the contact surfaces can be formed as a sole 24*a* fitted externally onto the stopper elements 14. The sole 24*a* can be serrated externally, and correspondingly the contact surfaces 24 as described previously can alternatively be serrated also. In this embodiment, the back support 22 can be threaded over the rope 30 and connected to the rope stopper 10 after it is arranged about the rope 30.

However, it is preferred that the contact surfaces described for both the variants are formed in an arch and have a smooth outer surface, and/or alternatively they can be equipped with a layer in the form of, for example, a rubber covering. The arched shape of the contact surface or the covering can change with circumference to adjust to the fibre rope for both large and small diameters, i.e. that the radius of the arched shape changes along the circumference of the stopper element.

For both variants, the stopper elements can also be controlled by a motor so that a controlled rotation and locking is provided. The stopper elements can be equipped with, or connected to, cogwheels or other drive appliances/drive units, for example, placed inside the frame 12, for synchronous rotation of the elements. For this purpose, a hydraulic motor, for example, can be used, indicated by the reference number 32 in FIG. 13, which is connected to the shaft of one of the stopper elements. Thereby, in activating the motor the other stopper elements will also be activated and rotated via the cogwheels or the drive appliance. Linear transmission can also be used.

The bearing 20 can be in the form of a shaft that is connected to said cogwheels or drive unit.

The invention claimed is:

1. A combination of a vessel, a rope stopper and a fibre rope, where the rope stopper is placed on a deck of the vessel, said rope stopper comprises a frame equipped with several rotary stopper elements, arranged to grip and secure the fibre rope that runs through the rope stopper, wherein the stopper elements are arranged radially in an opening in the frame, said opening being a through-running opening to receive the fibre rope, and where the stopper elements are placed about an axis of the through-running fibre rope, arranged to lock the fibre rope, and the rope stopper is equipped with a back support, in which the back support is designed with an arched back side arranged to rest against existing equipment on the deck of the vessel.

2. Combination according to claim 1, wherein the back side of the back support is designed with a parabolic or spherical shape.

3. Combination according to claim 1, wherein the back support is releasable mounted to the rope stopper.

4. Combination according to claim 1, wherein the stopper elements are equipped with at least one stopper element comprising a bearing point and an outer surface having a contact surface, wherein during rotation of the stopper elements the stopper elements are arranged to lock the fibre rope, and the contact surface is arranged at a point on the outer surface of the at least one stopper element that lies further away from the bearing point of the at least one stopper element than at least most other points of the outer surface of the at least one stopper element.

5. Combination according to claim 4, wherein said at least one stopper element is supported eccentrically with regard to the contact surface of the at least one stopper element with the fibre rope.

6. Combination according to claim 1, wherein the at least one stopper element has an eccentric shape or an oval shape.

7. Combination according to claim 4, wherein the contact surface is shaped externally with an arched radius.

8. Combination according to claim 7, wherein the contact surface is equipped with a rubber covering.

9. Combination according to claim 8, wherein the contact surface comprises an arched shape and the arched shape of the contact surface, or the rubber covering, changes around a circumference about the stopper elements.

10. Combination according to claim 1, wherein said back support is placed between cylinders of a towing pin.

11. Combination according to claim 1, wherein the stopper elements are arranged for synchronous rotation.

12. Combination according to claim 1, wherein the rope stopper comprises at least one stopper element and other stopper elements wherein a motor is connected to the at least one stopper element and that said at least one stopper element is connected via a drive unit with the other stopper elements that are not connected to the motor.

* * * * *